US008413469B2

(12) United States Patent
Lapp et al.

(10) Patent No.: US 8,413,469 B2
(45) Date of Patent: Apr. 9, 2013

(54) CUT PROTECTION GLOVE

(75) Inventors: Verena Lapp, Mörfelden-Walldorf (DE); Wolfgang Kesting, Bardowick (DE)

(73) Assignee: PROFAS GmbH & Co. KG, Luneburg (DE)

( * ) Notice: Subject to any disclaimer, the term of this patent is extended or adjusted under 35 U.S.C. 154(b) by 1312 days.

(21) Appl. No.: 11/952,382

(22) Filed: Dec. 7, 2007

(65) Prior Publication Data

US 2008/0134412 A1 Jun. 12, 2008

(30) Foreign Application Priority Data

Dec. 12, 2006 (DE) ..... 10 2006 059 086

(51) Int. Cl.
*D04B 7/34* (2006.01)
*A41D 13/08* (2006.01)

(52) U.S. Cl. ..... 66/174; 66/202; 2/16; 2/161.6; 2/167

(58) Field of Classification Search ..... 66/169 R, 66/170, 171, 174, 202; 2/161.6, 16, 167
See application file for complete search history.

(56) References Cited

U.S. PATENT DOCUMENTS

| | | | | |
|---|---|---|---|---|
| 4,089,069 | A * | 5/1978 | Vistins | 2/161.8 |
| 5,138,719 | A * | 8/1992 | Orlianges et al. | 2/168 |
| 5,514,457 | A * | 5/1996 | Fels et al. | 2/2.5 |
| 6,532,724 | B2 * | 3/2003 | Patrick | 57/229 |
| 6,666,235 | B2 * | 12/2003 | Chi et al. | 139/420 A |
| 6,782,721 | B1 * | 8/2004 | Vero et al. | 66/171 |
| 7,060,211 | B2 * | 6/2006 | Oda | 264/103 |
| 7,313,906 | B2 * | 1/2008 | Zhou et al. | 57/252 |
| 7,549,281 | B2 * | 6/2009 | Kuwano et al. | 57/243 |
| 7,634,924 | B2 * | 12/2009 | Chuang et al. | 66/198 |
| 7,654,116 | B1 * | 2/2010 | Trelease | 66/176 |
| 8,051,495 | B2 * | 11/2011 | Lee | 2/54 |
| 2006/0010929 | A1 * | 1/2006 | Chuang et al. | 66/171 |
| 2008/0134412 | A1 * | 6/2008 | Lapp et al. | 2/161.8 |
| 2009/0019624 | A1 * | 1/2009 | Birk et al. | 2/455 |
| 2010/0031411 | A1 * | 2/2010 | Andrews | 2/20 |

FOREIGN PATENT DOCUMENTS

| | | | |
|---|---|---|---|
| DE | 86 10 809.3 | | 7/1986 |
| DE | 202005008041 | U1 | 9/2005 |
| EP | 1 679 394 | A1 | 1/2004 |
| JP | 1321936 | | 12/1989 |
| WO | 9003462 | | 4/1990 |
| WO | 2005002376 | A1 | 1/2005 |

* cited by examiner

*Primary Examiner* — Danny Worrell

(74) *Attorney, Agent, or Firm* — Vidas, Arrett & Steinkraus, P.A.

(57) ABSTRACT

A cut protection glove, made of a textile material having a cut resistant fibre, characterized in that the textile material has a bamboo fibre.

9 Claims, 1 Drawing Sheet

CUT PROTECTION GLOVE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to cut protection gloves made of a textile material with a cut resistant fibre.

Such cut protection gloves can protect the user against cutting injuries of all kinds, for instance when working with sharp-edged objects, tools, knives or other blades. The protection effect against cuttings is achieved in that special cut resistant fibres are contained in the material from which the glove is made.

Different materials are used as the cut resistant fibres, which have enhanced cut resistance compared with other frequently processed fibres, those from cotton, polyamide or polyester for instance. Fibres of glass, aramides, high density polyethylene, high density polymers or metals are frequently used. A multiplicity of such cut resistant fibres is known from the European Patent Document EP 0 435 889 B2, the entire contents of which is incorporated herein by reference, among others.

In order to provide effective cutting protection, the cut resistant fibres and the textile materials made there from have a series of properties, which adversely affect a high wearing comfort of cut protection gloves made from these materials. Among these, there is a high stiffness in particular, which can limit the perfect fit, the dexterity and the tactility, and also a humidity take-up ability which is significantly reduced with respect to other textile materials, which can lead to increased sweating and to an unfavourable microclimate in the gloves. When using filament yarns in particular, the skin's sensorial ability is also deteriorated, because textile materials made from such yarns have a relatively smooth and closed surface structure, which sits closer to the skin than other textiles with a more open structure with small fibres sticking out. Thus, such cut protection gloves might stick more to skin which is wetted by sweat.

In the context of the generation of sweat taking place more severely with gloves from synthetic fibres, problems through bacterial contamination and the generation of disagreeable odour's might also occur.

Just with cut protection gloves for the professional field, which have frequently to be worn over longer periods of time, a high wearing comfort is very important. Insufficient comfort properties may even lead to safety risks in the practical use, because in this case, the users tend to do off the cut protection gloves for a while.

In order to increase the wearing comfort of cut protection gloves, it is known to combine the textile material having the cut resistant fibres with an additional textile material. The additional textile material is comprised of fibres with better comfort properties, of cotton for instance, and is processed to a liner or to an inside cladding. This liner is glued or sewed together with the cut protection material, so that the inner sides of such a glove are formed by the material with the better comfort properties. Various realisations of an inner cladding for gloves are known from the German utility document 20 2005 008 041 U1, the entire contents of which is incorporated herein by reference.

Based on this, it is the objective of the present invention to provide a cut protection glove made of a textile material having a cut resistant fibre, which can be manufactured in a simple way and which has improved comfort properties.

BRIEF SUMMARY OF THE INVENTION

The cut protection glove of the present invention made from a textile material with a cut resistant fibre is characterized in that the textile material incorporates a bamboo fibre. The textile material can be an arbitrary material made up of fibres, a knitted fabric, a woven fabric or a tissue for instance, also designated with the general expression cloth in the common language. The textile material incorporates a cut resistant fibre, i.e. a fibre with an enhanced cut resistance compared to ordinary fibre materials. In this, the textile material and the cut resistant fibre are processed into one single textile material. Different cut resistant fibres can also be combined in the textile material. The content of the cut resistant fibre in the textile material is as high that even the textile material has an increased cut resistance. In addition, the textile material has a bamboo fibre. Thus, the cut resistant fibre and the bamboo fibre are processed into one single textile material. The material can also have further fibres. It is also possible that the cut protection glove has a further textile material, in the form of a reinforcement or a cushion, for instance.

Bamboo fibres are cellulose fibres which are obtained from the bamboo plant. The bamboo fibres are known as bast fibres and also as regenerated bamboo fibres. A regenerated bamboo fibre is preferably used. These fibres are very soft and have particularly good grip properties, which are comparable to those of viscose or silk. The fibres have a gloss giving the appearance of high value, and they are particularly long-living and wear-resistant. In addition, the fibres are particularly lightweight. Furthermore, the bamboo fibres have a particularly high take-up ability for humidity through their particular micro-structure, and they can release the once taken-up humidity particularly quickly again. Through the combination of the bamboo fibres with the cut resistant fibres into one single textile material, even a cut protection glove made from this material has substantially improved comfort properties. Through the take-up ability for humidity, the glove does not feel wet to the touch even at relatively strong sweating. At the same time, a pleasant cooling effect is achieved by the quick release of the humidity ingested by the textile material, which counter-acts excessive sweating. Due to the natural anti-bacterial properties of the bamboo plants, the same are normally cultivated without using pesticides, and a chemical antibacterial finish can be omitted. The danger of allergic reactions or skin irritations is substantially reduced by this. These favourable antibacterial properties remain conserved even after washing several times.

A further advantage of the combination of a cut resistant fibre with a bamboo fibre into one single textile material is that the production of the gloves made from this material is greatly simplified, because gluing or sewing together of different layer's of material is not necessary.

In a particularly preferred embodiment, the textile material has a cut resistant yarn with the cut resistant fibre and a bamboo yarn with the bamboo fibre. Thus, the cut resistant fibres and the bamboo fibres are each processed into one separate yarn, from which the textile material is produced by machine-knitting, weaving or entangling. The use of different yarns permits a particularly simple and targeted combination of the two fibres by conventional processing methods, like knitting machines, for instance. In doing so, the composition of the textile material can be influenced by corresponding processing of the two yarns, so that the content of cut resistant fibres is increased in the particularly stressed portions of the cut protection glove with respect to less stressed portions, for instance.

In a further preferred embodiment of the present invention, the inner side of the cut protection glove is formed by the bamboo yarn. Thus, it is provided to process the two yarns with each other to the textile material such that the material facing the skin is essentially the bamboo yarn. The advantageous comfort properties of the bamboo yarn, the pleasant skin feeling in particular, take optimally advantage by doing so. Preferably, the outer side of the cut protection glove is substantially formed by the cut resistant yarn, or it has an increased content of this yarn.

According to a further preferred embodiment of the present invention, the bamboo yarn and the cut resistant yarn form a two-layer knitted fabric. In this it is provided that an inner layer of the knitted fabric is formed by the bamboo yarn and an outer layer by the cut resistant yarn. Both yarns are combined with each other in the manufacture of the knitted fabric and are intricated into each other. By a suitable knitting method, one single textile material with the advantageous two-layer structure is produced in doing so, the so-called "double-face-structure".

In a further preferred embodiment of the present invention, the bamboo yarn forms a cladding. The cladding is located on the inner side of the cut protection glove.

In a further preferred embodiment of the present invention, the cut resistant fibre is processed in a core-sheath-yarn. By doing so, the properties of the cut resistant yarn formed by the core-sheath-yarn can be improved themselves.

According to a further preferred embodiment of the present invention, the core of the core-sheath-yarn is comprised of metal or a glass fibre. In this case, the core of the core-sheath-yarn contributes in particular to the enhanced cut resistance.

In a further preferred embodiment of the present invention, the sheath of the core-sheath-yarn is comprised of polyester, polyamide, high-density polyethylene, aramide or cellulose yarn. Thus, depending on the selection of the material, the sheath of the core-sheath-yarn can contribute to the enhanced cut resistance, when using aramide for instance, or the sheath can improve the comfort properties of the cut resistant yarn, by a wrapping with cellulose yarns for instance.

According to a further preferred embodiment of the present invention, the sheath of the core-sheath-yam is comprised of the bamboo fibre. In this case, the advantageous properties of the bamboo fibre can be integrated into the cut resistant yarn. Thus, it is possible to produce the textile fabric from one single yarn, which contains the cut resistant fibre as well as the bamboo fibre. However, it is also possible to process further bamboo fibres or a bamboo yarn made from the same to the textile material, in addition to a core-sheath-yam with the bamboo fibre which has an increased cut resistance. Thus, there are a manifold of possibilities to adapt the properties of the textile material to the respective requirements, the compromise between optimum wearing comfort and optimum cut protection properties in particular.

In a further preferred embodiment of the present invention, the textile material has a coating on the outer side. Preferably, the coating is comprised of nitrile, chloroprene or polyurethane. By means of the coating, additional protection properties can be imparted to the cut protection glove, tightness against liquids and resistance against chemicals for instance. The nitrile coating is liquid-tight and it may cover the cut protection glove completely or partially. Preferably, only the inner hand, the fingers and the thumb are provided with the coating, whereas the back of the hand remains uncoated. By doing so, the breathing activity of the cut protection glove is maintained at least partially.

BRIEF DESCRIPTION OF THE SEVERAL VIEWS OF THE DRAWINGS

In the following, the present invention is explained in more detail by means of an example of its realisation depicted in three figures.

DETAILED DESCRIPTION OF THE INVENTION

Figure 1:
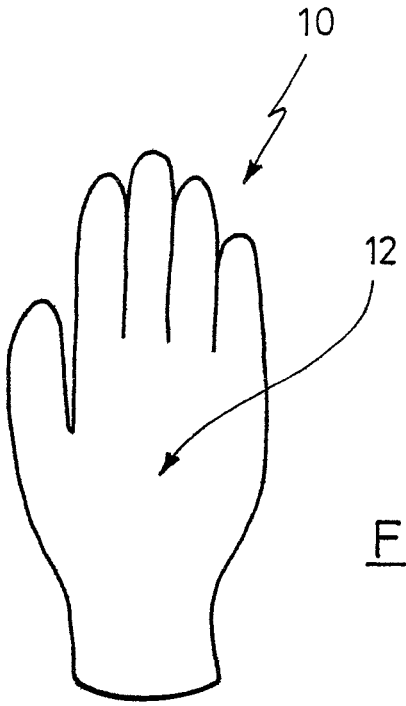
FIG. 1 shows a cut protection glove of the present invention.

While this invention may be embodied in many different forms, there are described in detail herein a specific preferred embodiment of the invention. This description is an exemplification of the principles of the invention and is not intended to limit the invention to the particular embodiment illustrated FIG. 1 shows a cut protection glove of the present invention, which has been knitted completely on a special glove knitting machine. The meshwork produced by the knitting machine has a "single-Jersey"-bonding. The subdivision of the knitting machine is thirteen gauge, i.e. thirteen needles per inch. Such knitting machines can process or knit together, respectively, different yarns from different yarn rolls at the same time. The structure depicted in FIG. 2 can be achieved by a special yarn guiding in this.

Figure 2:
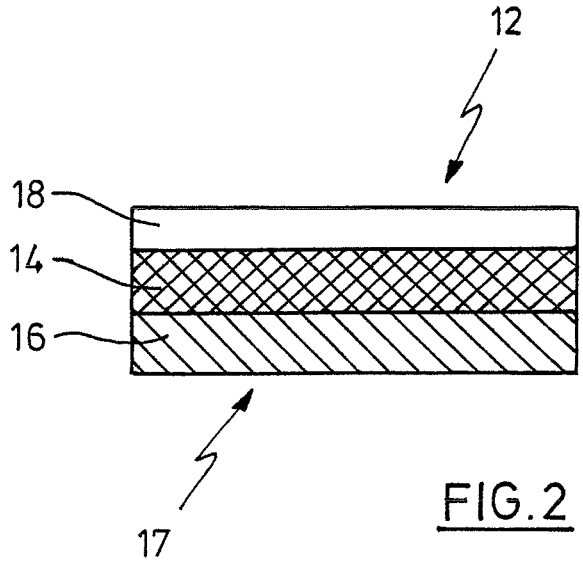
FIG. 2 shows a cut-out of the textile material of the cut protection glove of FIG. 1, in a cross-section.

The material of the knitted glove depicted in a cross-section in FIG. 2 is comprised of three layers. The middle layer 14 has a cut resistant yarn on the side facing the hand, and it is knitted together with a further material layer 16 comprised of the bamboo yarn. The two layers 14 and 16 form a double-layer knitted fabric produced by the knitting machine. By means of a dipping method, the outer side of the glove is provided with a nitrile coating 18 after the knitting process. The inner side 17 of the double-layer knitted fabric facing the skin is formed exclusively by the bamboo yarn processed to the inner layer 16. The bamboo yarn has a metric number of Nm 50/1. During the knitting process, the bamboo yarn is entangled with the cut resistant yarn of the outer material layer 14 of the knitted fabric.

Figure 3:
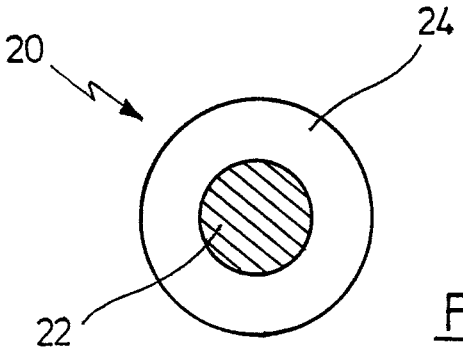
FIG. 3 shows a core-sheath-yarn which is used as a cut resistant yarn in the textile material according to FIG. 2, in a cross-section.

In FIG. 3, the structure of the core-sheath-yarn 20 is sketched out, which serves as a cut resistant yarn for the outer material layer 14 of the knitted fabric. The core-sheath-yarn 20 has a core 22, which is comprised of a glass-fibre multifilament with a degree of fineness of 110 dtex. This glass fibre multifilament core is enveloped by a sheathing 24 of polyester yarn, two polyester yarns of fineness degree 110 dtex being used for this.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g., each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A cut protection glove, made of a textile material having a first layer (14) and a second layer (16), the textile material having a cut resistant fibre, wherein the cut resistant fibre is processed in a core-sheath-yarn (20), the textile material has a bamboo fibre, the cut resistant fibre and the bamboo fibre are processed into one single material, the sheath (24) of the core-sheath-yarn (20) is comprised of the bamboo fibre and the textile material has a liquid-tight coating (18) on an outer side of the textile material, the outer side of the textile material forming an outer side of the glove.

2. A cut protection glove according to claim 1, characterized in that the textile material has a cut resistant yarn with the cut resistant fibre and a bamboo yarn with the bamboo fibre.

3. A cut protection glove according to claim 2, characterized in that an inner side (16) of the cut protection glove is formed by the bamboo yarn.

4. A cut protection glove according to claim 3, characterized in that the bamboo yarn and the cut resistant yarn form a double-layered knitted fabric (14, 16).

5. A cut protection glove according to claim 4, characterized in that the bamboo yarn forms a cladding (16).

6. A cut protection glove according to claim 1, characterized in that the core (22) of the core-sheath-yarn (20) is comprised of metal or a glass fibre.

7. A cut protection glove according to claim 1, characterized in that the coating (18) is comprised of nitrile, chloroprene or polyurethane.

8. A cut protection glove according to claim 1, characterized in that the coating (18) is comprised of latex or polyvinylchloride.

9. A cut protection glove according to claim 7, characterized in that naps are provided on the coating.

* * * * *